United States Patent [19]

Geist

[11] 4,159,116

[45] Jun. 26, 1979

[54] STRESS RELIEVING DEVICE

[76] Inventor: Jacob M. Geist, 2720 Highland St., Allentown, Pa. 18104

[21] Appl. No.: 689,721

[22] Filed: May 25, 1976

[51] Int. Cl.[2] ..... A63B 71/14

[52] U.S. Cl. ..... 273/166; 2/161 A

[58] Field of Search ..... 273/54 B, 165, 166, 273/81 R, 81 D, 81.4, 24, 26 C; 128/87 A; 2/159–161 A, 163; 46/DIG. 1; 272/68

[56] References Cited

U.S. PATENT DOCUMENTS

| | | | |
|---|---|---|---|
| 1,587,287 | 6/1926 | Denman | 273/165 |
| 1,692,201 | 11/1928 | Denman et al. | 273/166 |
| 2,079,261 | 5/1937 | Pardoe | 273/166 |
| 2,273,028 | 2/1942 | Eaton | 128/87 A |
| 3,091,455 | 5/1963 | De Mire | 273/54 B |
| 3,328,029 | 6/1967 | Paige | 273/54 B |
| 3,436,075 | 4/1969 | Robinson | 46/DIG. 1 |
| 3,595,575 | 7/1971 | Gooch | 2/161 A X |
| 3,922,724 | 12/1975 | Shockovsky | 2/161 A |
| 3,938,510 | 2/1976 | Gerber | 128/87 A X |
| 4,025,077 | 5/1977 | Thompson | 273/166 |

*Primary Examiner*—Richard J. Apley

[57] ABSTRACT

The device of this invention is intended to reduce the possibility of inflammation of the muscles in the vicinity of the elbow resulting from prolonged gripping by the user of the handles of tools, tennis rackets or the like. The device is designed to support the little or fourth finger of the hand being used to grip the handle, maintaining the finger in a slightly crooked condition and well out of contact with the handle while the remaining fingers actually contact and grip the handle.

9 Claims, 3 Drawing Figures

STRESS RELIEVING DEVICE

BACKGROUND OF THE INVENTION (1) Field of the Invention

This invention concerns a device to reduce the possibility of inflammation of the muscles and tendons in the vicinity of the elbow, and also to increase the strength of a normal grip.

When handles of sports equipment such as tennis rackets, squash rackets, paddle ball rackets, etc. are gripped tightly, or when handles of tools such as screwdrivers, hammers, pliers, sledges, etc. are gripped tightly, the normal tendency is to use all of the fingers of the hand on one side of the handle, with the thumb on the other side, and then to squeeze the handle to maintain a tight grip. This gripping or squeezing action places a stress on some of the tendons and muscles leading from the fingers to the elbow, and the resulting stress or overstress leads to inflammation and/or pain of muscles and/or tendons in the vicinity of the elbow. A common term for the resulting painful area in the vicinity of the elbow is "tennis elbow".

(2) Description of the Prior Art

Heretofore, various arm and elbow braces have been recommended and sold to treat or prevent "tennis elbow". These braces are usually in the form of an elastic bandage material that is either wound around the affected area of the wearer or is designed as an elastic cylindrical sleeve to fit over the area. While such braces may be successful in reducing pain of a wearer who has "tennis elbow", their success in preventing the inflammation has been extremely low.

SUMMARY OF THE INVENTION

The present invention provides a device, the use of which will reduce the likelihood of the occurrence or "tennis elbow"; and, if "tennis elbow" exists, then the use of the invented device will reduce the pain level. The device comprises a supporting means adapted to underlie the fourth or little finger of a wearer permitting only slight closing movement of said finger. When such supporting means is used by itself, then retention must depend on the partial closure of the finger being supported. However, it is preferred to combine the supporting means with means for retaining the supporting means beneath the finger. Such retaining means is attached to the supporting means and encircles the supported finger as a ring.

DESCRIPTION OF THE DRAWINGS

The invention will be better understood by reference to the drawings.

Referring to the drawings, FIG. 1 shows the supporting means 11 in the form of an elliptical or oval ring. Approximately one-half the circumference of the ring is adapted to fit beneath and support at least the middle section (between the first and second joints) of the fourth or little finger of the user. Although the elliptical shape is not critical, the curvature of the ring must be sufficient to permit the remaining fingers to grip handles or the like completely. The width of the ring is substantially equal to, but preferably slightly less than, the width of the finger.

For an adult male, the preferred dimension of the finger support is an oval or elliptically shaped ring with a major axis of approximately $1\frac{3}{4}$ inch and a minor axis of approximately $1\frac{3}{8}$ inch, approximately $\frac{1}{2}$ inch wide. However, the dimensions can be varied to be suitable for any individual, although the dimensions are not critical and there are only a few different sizes required to satisfy nearly all individuals. It should also be understood that an oval disk can be used instead of a ring.

The ring 11 should be of a reasonably rigid or stiff material, preferably light in weight, but sufficient to support the finger comfortably. Thus, metals such as aluminum, copper or the like, or plastics such as polymethylmethacrylate, epoxy resins or the like, or wood, or hard rubber, can be used. The essential aspect of the supporting means 11 is that it maintain the little finger in a flexed, extended position, to avoid overstressing muscles and tendons, and to allow the handle to be gripped tightly.

The retaining means 12 is connected to the supporting means 11 and adapted to encircle the middle section of the fourth or little finger. Its width is not critical; although its width should be sufficient to retain the ring 11 in a substantially fixed position during activity by the user. The material used for the retaining means 12 can be rigid or flexible. When a rigid material is used, e.g. aluminum or other metal, the retaining means 12 may be integrally connected (welded or brazed) to the supporting means 11.

Figure 2:
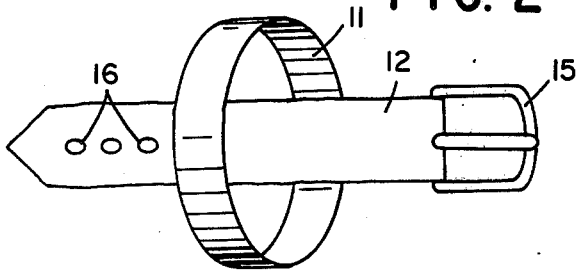
FIG. 2 is a view, in perspective, of another form of the device suitable for practicing the invention.

The preferred material for making the retaining means is a flexible or elastomeric material such as tape, strap or cloth that may be sewn or otherwise attached permanently to the supporting means 11. The retaining means 12 is preferably coated with an adhesive constituent or otherwise adapted in the areas 13 and 14 near its extremities so that, when the flexible materials encircle the finger, the retaining means 12 will fit tightly. Preferably, the materials used in the areas 13 and 14 will provide a self-gripping, non-permanent attachment to the wearer's finger when the areas 13 and 14 are overlapped. Such materials as Velcro® or the like that are re-usable over extended periods are most useful for this purpose. It is also apparent that a strap of leather, plastic, or textile material complete with buckle 15 at one extremity and several openings 16 spaced longitudinally near the opposite extremity of the retaining means 12, as shown in FIG. 2, may also be used. Essentially, the retaining means 12 should be adapted to hold the support ring 11 to the finger, to maintain the desired degree of tightness, and to allow the support ring 11 to be placed in the most suitable and comfortable position.

Figure 3:
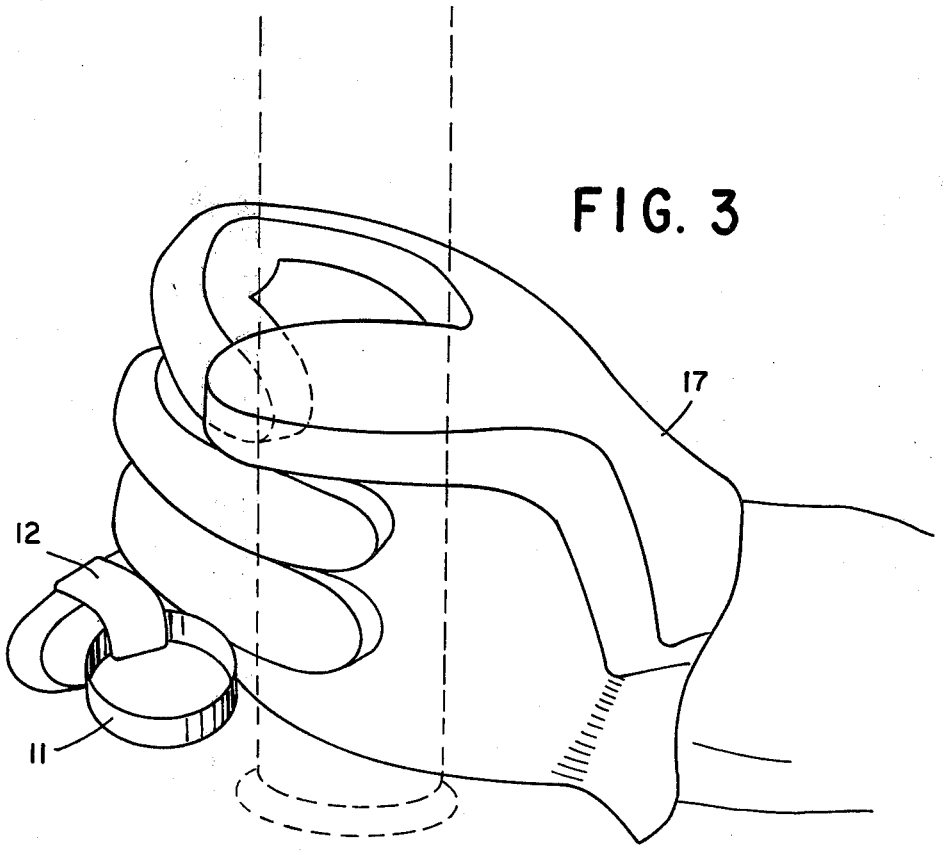
FIG. 3 is a view, in perspective, of a device representing the best mode contemplated for practicing this invention.

In FIG. 3, the retaining means 12 is of flexible material and is permanently attached to the little finger of glove 17 by sewing or otherwise to the rear of the glove. The two gripping areas 13 and 14 of the retaining means 12 are adapted to hold the supporting means 11 in the manner discussed with respect to FIG. 1 to provide a self-gripping non-permanent attachment for the supporting means 11 to the glove 17. The supporting means 11 is thus removable so that the retaining means 12 can be wrapped around the little finger of the glove 17 and the glove used normally (as a glove instead of as part of a stress relieving device) when the wearer is not gripping handles. The supporting means 11 shown in FIG.

Figure 1:
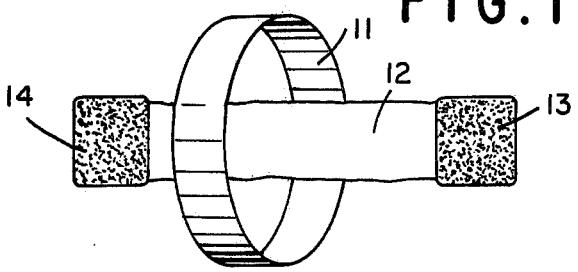
FIG. 1 is a view, in perspective, of one form of the device suitable for practicing this invention.

3 is substantially as described with respect to either FIG. 1 or FIG. 2.

It should also be understood that the supporting means 11 can be attached (sewn or otherwise) directly to the glove 17 without the necessity of using the retaining means 12 as shown in the figures. However, in so doing, one loses the flexibility of using the glove normally or for gripping purposes.

Although a glove for the right hand is shown, it is apparent that a similar glove for the left hand would be equally effective. The material used for the glove is not critical but can be made of leather or cloth. In fact, a mere covering for the little finger instead of a complete glove can also be used.

Although the success of this invention in relieving pain is not completely understood, it is believed that the use of a substantially rigid mechanical device to support the fourth or little finger in a slightly closed or relaxed position limits the stress which can be applied to some of the tendons, ligaments, and muscles in the vicinity of the elbow of the same hand; thereby avoiding stress or overstress of the tendons, ligaments, or muscles and avoiding pain or relieving pain. The design is such that the mechanical support can be utilized and still allow the hand to be used to maintain a tight grip on a handle of sports equipment or of tools, without interfering with the normal position or use of the hand (except for the little finger).

What is claimed is:

1. A device for relieving stress when gripping a handle comprising supporting means adapted to underlie only the entire fourth or little finger of the hand of a wearer without extending beyond the joint between said finger and said hand and sufficiently rigid to permit only slight closing movement of said finger while permitting all the remaining fingers of said hand to grip said handle; and means for retaining said supporting means beneath said fourth finger.

2. A device as in claim 1 wherein said supporting means extends longitudinally beneath said fourth finger, is curved to permit a slight curvature of said fourth finger and is adapted to contact the middle section of said fourth finger.

3. A device as in claim 1 wherein said retaining means is attached to said supporting means and consists essentially of a self-gripping, non-permanent fastener adapted to encircle said fourth finger.

4. A device as in claim 1 in combination with a glove wherein said retaining means is permanently attached to the outer surface of the fourth or little finger of said glove.

5. A device for relieving stress when gripping a handle comprising elliptical supporting means adapted to underlie the fourth or little finger of the hand of a wearer extending longitudinally beneath said fourth finger, curved to permit slight curvature of said fourth finger, adapted to contact the middle section of said finger and sufficiently rigid to permit only slight closing movement of said finger while permitting the remaining fingers of said hand to grip said handle; and means for retaining said supporting means beneath said fourth finger.

6. A device as in claim 5 wherein said supporting means is of metal and its width is slightly less than the width of said fourth finger.

7. A device as in claim 6 wherein said metal is aluminum.

8. A device as in claim 5 wherein said retaining means is attached to said supporting means and consists essentially of a self-gripping, nonpermanent fastener adapted to encircle said fourth finger.

9. A device as in claim 5 in combination with a glove wherein said retaining means is permanently attached to the outer surface of the fourth or little finger of said glove.

* * * * *